US011842720B2

(12) United States Patent
Daido

(10) Patent No.: US 11,842,720 B2
(45) Date of Patent: Dec. 12, 2023

(54) AUDIO PROCESSING METHOD AND AUDIO PROCESSING SYSTEM

(71) Applicant: YAMAHA CORPORATION, Hamamatsu (JP)

(72) Inventor: Ryunosuke Daido, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 307 days.

(21) Appl. No.: 17/306,123

(22) Filed: May 3, 2021

(65) Prior Publication Data

US 2021/0256959 A1 Aug. 19, 2021

Related U.S. Application Data

(63) Continuation of application No. PCT/JP2019/043511, filed on Nov. 6, 2019.

(30) Foreign Application Priority Data

Nov. 6, 2018 (JP) ..... 2018-209289

(51) Int. Cl.
*G10L 13/033* (2013.01)
*G10L 13/047* (2013.01)

(52) U.S. Cl.
CPC ..... *G10L 13/0335* (2013.01); *G10L 13/047* (2013.01)

(58) Field of Classification Search
CPC ..... G10L 13/0335; G10L 13/047
USPC ..... 704/261
See application file for complete search history.

(56) References Cited

U.S. PATENT DOCUMENTS

| | | | | |
|---|---|---|---|---|
| 6,304,846 | B1 | 10/2001 | George et al. | |
| 8,751,236 | B1 | 6/2014 | Fructuoso et al. | |
| 11,302,329 | B1 * | 4/2022 | Sun | G10L 25/51 |
| 11,495,206 | B2 * | 11/2022 | Daido | G06N 3/088 |
| 11,551,663 | B1 * | 1/2023 | Bissell | G10L 13/086 |

(Continued)

FOREIGN PATENT DOCUMENTS

| | | | |
|---|---|---|---|
| CN | 104050961 | A | 9/2014 |
| CN | 104766603 | A | 7/2015 |

(Continued)

OTHER PUBLICATIONS

Extended European search report issued in European Appln. No. 19882740.4 dated Jul. 1, 2022.

(Continued)

*Primary Examiner* — Susan I McFadden
(74) *Attorney, Agent, or Firm* — ROSSI, KIMMS & McDOWELL LLP

(57) ABSTRACT

An audio processing system and a method thereof generate a synthesis model that can input an audio signal to generate feature data that can be used by a signal generator to generate a modified audio signal. Specifically, a pre-trained synthesis model is first generated using training audio data. Thereafter, a re-trained synthesis model is established by additionally training the pre-trained synthesis model. Based on a received instruction to modify at least one of sounding conditions of an audio signal to be processed, feature data is generated by inputting additional condition data into the re-trained synthesis model. The signal generator generates the modified audio signal from the generated feature data.

7 Claims, 6 Drawing Sheets

(56) References Cited

U.S. PATENT DOCUMENTS

| | | | |
|---|---|---|---|
| 2011/0000360 | A1 | 1/2011 | Saino et al. |
| 2011/0004476 | A1 | 1/2011 | Saino et al. |
| 2013/0151256 | A1 | 6/2013 | Nakano et al. |
| 2013/0262119 | A1 | 10/2013 | Latorre-Martinez |
| 2015/0081306 | A1 | 3/2015 | Mori |
| 2016/0012035 | A1 | 1/2016 | Tachibana |
| 2016/0140951 | A1 | 5/2016 | Agiomyrgiannakis et al. |
| 2021/0256960 | A1 | 8/2021 | Daido et al. |

FOREIGN PATENT DOCUMENTS

| | | | |
|---|---|---|---|
| EP | 3739477 | A1 | 11/2020 |
| JP | 2007240564 | A | 9/2007 |
| JP | 2015060002 | A | 3/2015 |
| JP | 2015172769 | A | 10/2015 |
| JP | 2016020972 | A | 2/2016 |
| JP | 2016114740 | A | 6/2016 |
| JP | 2017032839 | A | 2/2017 |
| JP | 2017045073 | A | 3/2017 |
| JP | 2017107228 | A | 6/2017 |
| JP | 2018146803 | A | 9/2018 |
| WO | 2019139431 | A1 | 7/2019 |

OTHER PUBLICATIONS

MASE "HMM-based singing voice synthesis system using pitch-shifted pseudo training data", INTERSPEECH, 2010: pp. 845-848.
Blaauw "A Neural Parametric Singing Synthesizer Modeling Timbre and Expression from Natural Songs", Applied Sciences, vol. 7, No. 12, Dec. 18, 2017: pp. 1-23.
"What is Melodyne?" Celemony. <URL:https://www.celemony.com/en/melodyne/what-is-melodyne>, pp. 1-5.
International Search Report issued in Intl. Appln No. PCT/JP2019/043511 dated Jan. 21, 2020. English translation provided.
Written Opinion issued in Intl. Appln No. PCT/JP2019/043511 dated Jan. 21, 2020.
English translation of Written Opinion issued in Intl. Appln No. PCT/JP2019/043511 dated Jan. 21, 2020, previously cited in IDS filed May 3, 2021.
Office Action issued in Chinese Appln. No. 201980072998.7, dated Jun. 15, 2023. English machine translation provided.
Office Action issued in Chinese Appln. No. 201980072848.6, dated Jun. 19, 2023. English machine translation provided.
Office Action issued in U.S. Appl. No. 17/307,322 dated Jun. 9, 2023.
Patent Opposition in Japanese Patent Appln. No. 2018-209288 dated Feb. 10, 2021. English translation provided.
International Search Report issued in Intl. Appln. No. PCT/JP2019/043510 dated Jan. 21, 2020. English translation provided.
Written Opinion issued in Intl. Appln. No. PCT/JP2019/043510 dated Jan. 21, 2020. English translation provided.
International Preliminary Report on Patentability issued in Intl. Appln. No. PCT/JP2019/043510 dated May 11, 2021. English translation provided.
NOSE. "HMM-based speech synthesis with unsupervised labeling of accentual context based on F0 quantization and average voice model." Conference Paper in Acoustics, Speech, and Signal Processing. Apr. 2010: 4622-4625.
Notice of Reasons for Revocation issued in Japanese Patent No. 6747489 dated Apr. 12, 2021. English machine translation provided.
Office Action issued in Japanese Appln. No. 2020-133036 dated Jul. 5, 2022. English machine translation provided.
Yuhan "A Study on Representation of Speaker Information for DNN Speech Synthesis" technical research report for The Institute of Electronics Information and Communication Engineers, Aug. 2018: pp. 15 to 18. English abstract provided.
Extended European Search Report issued in European Appln. No. 19882179.5 dated Aug. 25, 2022.
NOSE. "HMM-based expressive singing voice synthesis with singing style control and robust pitch modeling." Computer Speech and Language. 2015: 308-322. vol. 34, No. 1.
Office Action issued in U.S. Appl. No. 17/307,322 dated Jan. 19, 2023.
Advisory Action issued in U.S. Appl. No. 17/307,322 dated Aug. 23, 2023.

* cited by examiner

AUDIO PROCESSING METHOD AND AUDIO PROCESSING SYSTEM

CROSS REFERENCE TO RELATED APPLICATIONS

This Application is a Continuation Application of PCT Application No. PCT/JP2019/043511, filed Nov. 6, 2019, and is based on and claims priority from Japanese Patent Application No. 2018-209289, filed Nov. 6, 2018, the entire contents of each of which are incorporated herein by reference.

BACKGROUND

Technical Field

The present disclosure relates to techniques for processing audio signals.

Description of Related Art

Proposals have been made for techniques for editing audio signals representative of a variety of types of audio, such as voices singing or musical sounds, in response to a user's instruction. For example, non-patent document 1 ("What is Melodyne?", searched Oct. 21, 2018, Internet, <https://www.celemony.com/en/melodyne/what-is-melodyne>) discloses a technique for editing an audio signal made by a user, in which pitch and amplitude of an audio signal for each note are analyzed and displayed.

However, a conventional technique can't rid of deterioration of sound quality of an audio signal caused by a modification of sounding conditions, for example, pitches.

SUMMARY

An aspect of this disclosure has been made in view of the circumstances described above, and it has an object to suppress a deterioration of sound quality of an audio signal caused by the modification of sounding conditions corresponding to the audio signal.

To solve the above problems, an audio processing method according an aspect of the present disclosure is implemented by a computer, and includes: establishing a re-trained synthesis model by additionally training a pre-trained synthesis model for generating feature data representative of acoustic features of an audio signal according to condition data representative of sounding conditions, using: first condition data representative of sounding conditions identified from a first audio signal of a first sound source; and first feature data representative of acoustic features of the first audio signal; receiving an instruction to modify at least one of the sounding conditions of the first audio signal; generating second feature data by inputting second condition data representative of the modified at least one sounding condition into the re-trained synthesis model established by the additional training; and generating a modified audio signal in accordance with the generated second feature data.

An audio processing system according to one aspect of the present disclosure is an audio processing system including: at least one memory storing instructions; and at least one processor that implements the instructions to: establish a re-trained synthesis model by additional training a pre-trained synthesis model for generating feature data representative of acoustic features of an audio signal according to condition data representative of sounding conditions, using: first condition data representative of sounding conditions identified from a first audio signal of a first sound source; and first feature data representative of acoustic features of the first audio signal; receive an instruction to modify at least one of the sounding conditions of the first audio signal; generate second feature data by inputting second condition data representative of the modified at least one sounding condition into the re-trained synthesis model established by the additional training; and generate a modified audio signal in accordance with the generated second feature data.

A non-transitory medium according to one aspect of the present disclosure is a non-transitory medium storing a program executable by a computer to an audio processing system to execute a method including: establishing a re-trained synthesis model by additionally training a pre-trained synthesis model for generating feature data representative of acoustic features of an audio signal according to condition data representative of sounding conditions, using: first condition data representative of sounding conditions identified from a first audio signal of a first sound source; and first feature data representative of acoustic features of the first audio signal; receiving an instruction to modify at least one of the sounding conditions of the first audio signal; generating second feature data by inputting second condition data representative of the modified at least one sounding condition into the re-trained synthesis model established by the additional training; and generating a modified audio signal in accordance with the generated second feature data.

DESCRIPTION OF THE EMBODIMENTS

First Embodiment

Figure 1:
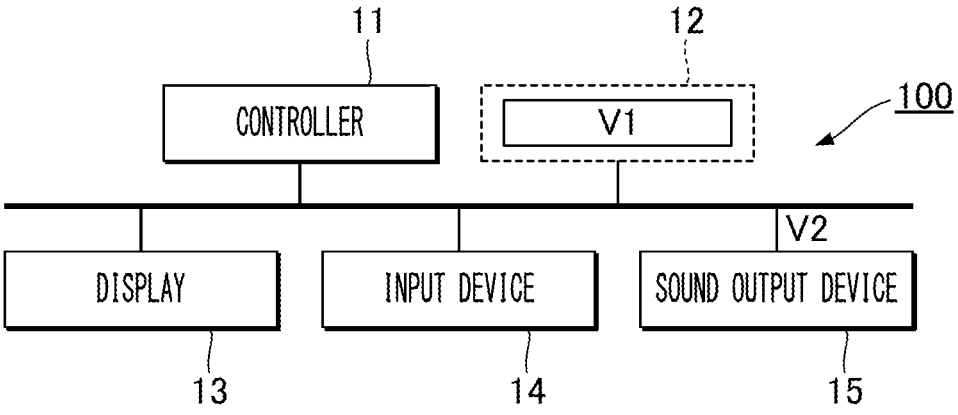
FIG. 1 is a block diagram showing an example of a configuration of an audio processing system in the first embodiment.

FIG. 1 is a block diagram showing an example of a configuration of an audio processing system 100 according to the first embodiment. The audio processing system 100 in the first embodiment is configured by a computer system including a controller 11, a memory 12, a display 13, an input device 14, and a sound output device 15. In one example, an information terminal, such as a cell phone, a smartphone, a personal computer and other similar devices, may be used as the audio processing system 100. The audio processing system 100 may be a single device or may be a set of multiple independent devices.

The controller 11 includes one or more processors that control each element of the audio processing system 100. The controller 11 includes one or more types of processors, examples of which include a Central Processing Unit (CPU), a Sound Processing Unit (SPU), a Digital Signal Processor (DSP), a Field Programmable Gate Array (FPGA), and an Application Specific Integrated Circuit (ASIC). The memory 12 refers to one or more memories configured by a known recording medium, such as a magnetic recording medium or a semiconductor recording medium. The memory 12 holds a program executed by the controller 11 and a variety of data used by the controller 11. The memory 12 may be configured by a combination of multiple types of recording medias. A portable memory medium detachable from the audio processing system 100 or an online storage, which is an example of an external memory medium accessed by the audio processing system 100 via a communication network, may be used as the memory 12.

The memory 12 in the first embodiment stores audio signals V1 representative of audios related to specific tunes. In the following description, an audio signal V1 is assumed. The audio signal V1 represents the singing voice of a tune vocalized by a specific singer (hereinafter, referred to as an "additional singer"). Specifically, an audio signal V1 recorded in a recording medium, such as a music CD, or an audio signal V1 received via a communication network is stored in the memory 12. Any file format may be used to store the audio signal V1. The controller 11 in the first embodiment generates an audio signal V2 of which features reflect singing conditions modified by the user's instruction. The singing conditions represent a variety of conditions related to the audio signal V1 stored in the memory 12. In one example, the singing conditions include pitches, volumes, and phonetic identifiers.

The display 13 displays an image based on an instruction from the controller 11. In one example, a liquid crystal display panel may be used for the display 13. The input device 14 receives input operations by the user. In one example, a user input element, or a touch panel that detects a touch of the user to the display surface of the display 13, may be used as the input device 14. In one example, the sound output device 15 is a speaker or headphones, and it outputs sound in accordance with the audio signal V2 generated by the controller 11.

Figure 2:
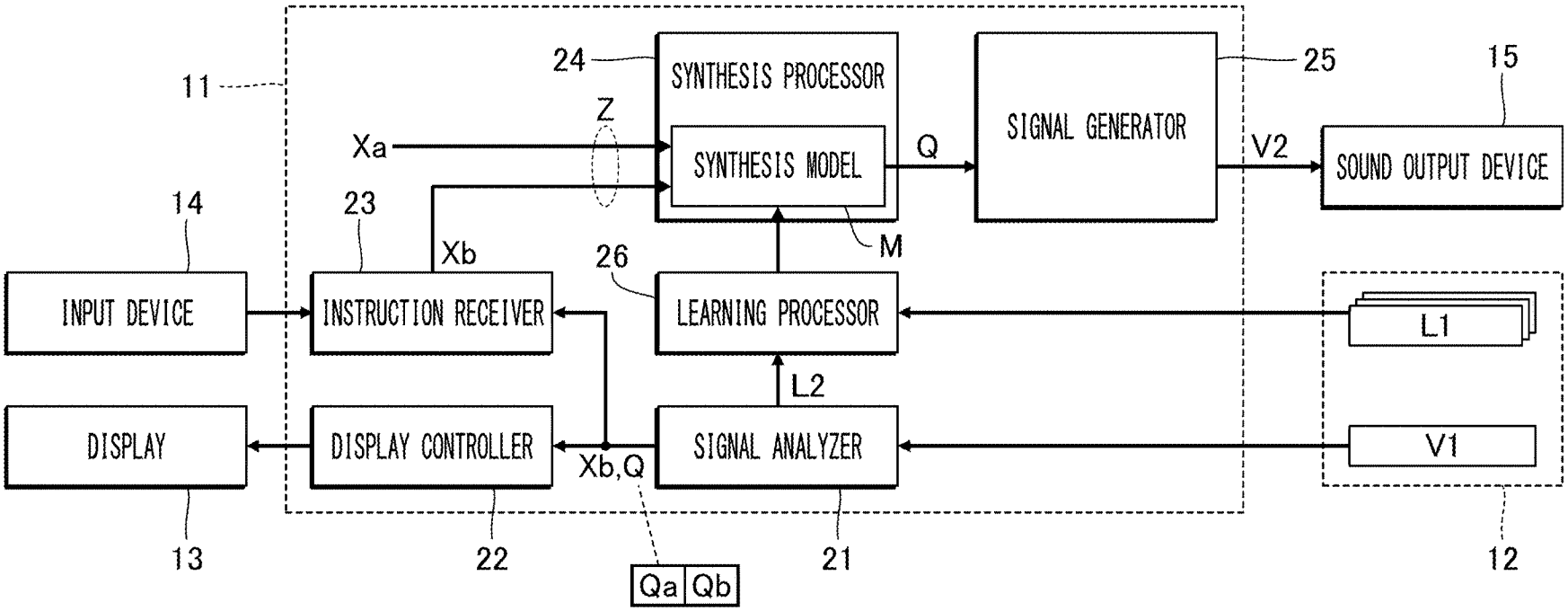
FIG. 2 is a block diagram showing an example of a functional configuration of the audio processing system.

FIG. 2 is a block diagram showing an example of functions created by execution, by the controller 11, of a program stored in the memory 12. The controller 11 in the first embodiment creates a signal analyzer 21, a display controller 22, an instruction receiver 23, a synthesis processor 24, a signal generator 25, and a learning processor 26. The functions of the controller 11 may be created by use of multiple independent devices. Some or all of the functions of the controller 11 may be created by electronic circuits therefor.

The signal analyzer 21 analyzes the audio signal V1 stored in the memory 12. Specifically, the signal analyzer 21 generates, from the audio signal V1, (i) condition data Xb representative of the singing conditions of a singing voice represented by the audio signal V1, and (ii) feature data Q representative of features of the singing voice. The condition data Xb in the first embodiment are a series of pieces of data which specify, as the singing conditions, a pitch, a phonetic identifier (a pronounced letter) and a sound period for each note of a series of notes in the tune. In one example, the format of the condition data Xb can be compliant with the MIDI (Musical Instrument Digital Interface) standard. Any known analysis method (e.g., automatic notation method) may be used for generation of the condition data Xb by the signal analyzer 21. The condition data Xb are not limited to data generated from the audio signal V1. The score data of the tune sang by an additional singer can be used for the condition data Xb.

Feature data Q represents features of sound represented by the audio signal V1. A piece of feature data Q in the first embodiment includes a fundamental frequency (a pitch) Qa and a spectral envelope Qb. The spectral envelope Qb is a contour of the frequency spectrum of the audio signal V1. A piece of feature data Q is generated sequentially for each time unit of predetermined length (e.g., 5 milliseconds). In other words, the signal analyzer 21 in the first embodiment generates a series of fundamental frequencies Qa and a series of spectral envelopes Qb. Any known frequency analysis method, such as discrete Fourier transform, can be employed for generation of the feature data Q by the signal analyzer 21.

The display controller 22 displays an image on the display 13. The display controller 22 in the first embodiment displays an editing screen G shown in FIG. 3 on the display 13. The editing screen G is an image displayed for the user to change the singing condition related to the audio signal V1.

On the editing screen G, there are a time axis (the horizontal axis) and a pitch axis (the vertical axis) that are orthogonal to each other. Note images Ga, pitch images Gb, and waveform images Gc are disposed on the editing screen G.

The note images Ga represent a series of notes of the tune represented by the audio signal V1. The display controller 22 disposes a series of note images Ga on the editing screen G in accordance with the condition data Xb generated by the signal analyzer 21. Specifically, the position of each note image Ga in the direction of the pitch axis is determined in accordance with a pitch of the corresponding note represented by the condition data Xb. The position of each note image Ga in the direction of the time axis is determined according to a boundary (start or end point) of the sounding period of the corresponding note identified by the condition data Xb. The display length of each note image Ga in the direction of the time axis is determined in accordance with duration of the sound period of the corresponding note identified by the condition data Xb. In short, a piano roll is displayed, in which the series of notes of the audio signal V1 are displayed as the series of note images Ga. In addition, in each of the note images Ga, a phonetic identifier Gd of the corresponding note represented by the condition datum Xb is disposed. The phonetic identifier Gd can be represented by one or more letters, or can be represented as a combination of phonemes.

Figure 3:
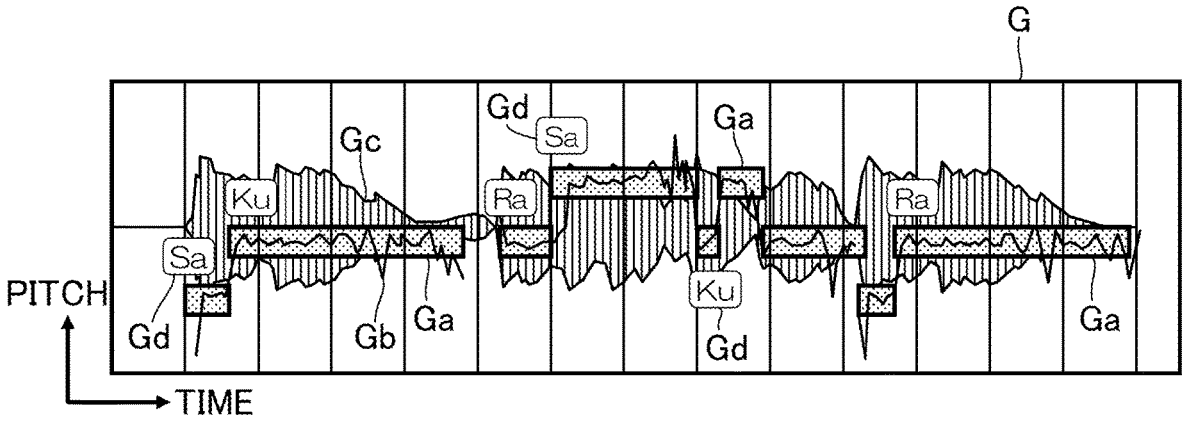
FIG. 3 is a schematic diagram of an editing screen.

The pitch images Gb represent a series of fundamental frequencies Qa of the audio signal V1. The display controller 22 disposes the series of the pitch images Gb on the editing screen G in accordance with the series of fundamental frequencies Qa of the feature data Q generated by the signal analyzer 21. The waveform images Gc represent waveform of the audio signal V1. In FIG. 3, the whole waveform images Gc of the audio signal V1 are disposed at a predetermined position in the direction of the pitch axis. However, the wave form of the audio signal V1 can be divided into individual waveform of each note, and the waveform of each note can be disposed overlapping with a note image Ga of the note. In other words, a waveform of each note obtained by dividing the audio signal V1 may be disposed at a position corresponding to a pitch of the note in the direction of the pitch axis.

The singing conditions of the audio signal V1 are adjustable by the user's appropriate input operation on the input device 14 while viewing the editing screen G displayed on the display 13. Specifically, if the user moves a note image Ga in the direction of the pitch axis, the pitch of the note corresponding to the note image Ga is modified by the user's instruction. Furthermore, if the user moves or stretches a note image Ga in the direction of the time axis, the sound period (the start point or the end point) of the note corresponding to the note image Ga is modified by the user's instruction. A phonetic identifier Gd attached to a note image Ga can be modified by a user's instruction.

The instruction receiver 23 shown in FIG. 2 receives instructions for changing any of the singing conditions (e.g., a pitch, a phonetic identifier or a sound period) related to the audio signal V1. The instruction receiver 23 in the first embodiment changes condition data Xb generated by the signal analyzer 21 in accordance with an instruction received from the user. In other words, a singing condition (a pitch, a phonetic identifier or a sound period) of a desired note of the tune is modified according to the user's instruction, and in turn, the condition data Xb including the changed singing condition is generated by the instruction receiver 23.

The synthesis processor 24 generates a series of pieces of feature data Q representative of acoustic features of an audio signal V2. The audio signal V2 reflects the modification of the singing conditions of the audio signal V1 according to the user's instruction. A piece of feature data Q includes a fundamental frequency Qa and a spectral envelope Qb of the audio signal V2. Apiece of feature datum Q is generated sequentially for each time unit (e.g., 5 milliseconds). In other words, the synthesis processor 24 in the first embodiment generates the series of fundamental frequencies Qa and the series of spectral envelopes Qb.

The signal generator 25 generates an audio signal V2 from the series of pieces of feature data Q generated by the synthesis processor 24. In one example, any known vocoder technique can be used to generate the audio signal V from the series of the feature data Q. Specifically, in a frequency spectrum corresponding to the fundamental frequency Qa, the signal generator 25 adjusts the intensity of each harmonic frequency in accordance with the spectral envelope Qb. Then the signal generator 25 converts the adjusted frequency spectrum into a time domain, to generate the audio signal V2. Upon supplying the audio signal V2 generated by the signal generator 25 to the sound output device 15, a sound corresponding to the audio signal V2 is emitted from the sound output device 15. In other words, the singing conditions of a singing voice represented by the audio signal V1 is modified according to the user's instruction, and the singing voice reflecting the modification is output from the sound output device 15. For convenience, illustration of a D/A converter for converting a digital audio signal V2 to an analog audio signal V2 is omitted.

In the first embodiment, a synthesis model M is used for generation of the feature data Q by the synthesis processor 24. Specifically, the synthesis processor 24 inputs input data Z including a piece of singer data Xa and condition data Xb into the synthesis model M, to generate a series of feature data Q.

The piece of singer data Xa represents acoustic features (e.g., voice quality) of a singing voice vocalized by a singer. The piece of singer data Xa in the first embodiment is represented as an embedding vector in a multidimensional first space (hereinafter, referred to as a "singer space"). The singer space refers to a continuous space, in which the position corresponding to each singer in the space is determined in accordance with acoustic features of the singing voice of the singer. The more similar the acoustic features of a first singer to that of a second singer among the different singers, the closer the vector of the first singer and the vector of the second singer in the singer space. As is clear from the foregoing description, the singer space is described as a space representative of the relations between pieces of acoustic features of different singers. The generation of the singer data Xa will be described later.

The synthesis model M is a statistical prediction model having learned relations between the input data Z and the feature data Q. The synthesis model M in the first embodiment is constituted by a deep neural network (DNN). Specifically, the synthesis model M is embodied by in a combination of the following (i) and (ii): (i) a program (e.g., a program module included in artificial intelligence software) that causes the controller 11 to perform a mathematical operation for generating the feature data Q from the input data Z, and (ii) coefficients applied to the mathematical operation. The coefficients defining the synthesis model M are determined by machine learning (in particular, by deep learning) technique with training data, and then are stored in the memory 12.

The learning processor 26 trains the synthesis model M by machine learning. The machine learning carried out by the learning processor 26 is classified into pre-training and additional training. The pre-training is a fundamental training processing, in which a large amount of training data L1 stored in the memory 12 is used to establish a well-trained synthesis model M. In contrast, the additional training is carried out after the pre-training, and requires a smaller amount of training data L2 as compared to the training data L1 for the pre-training.

Figure 4:
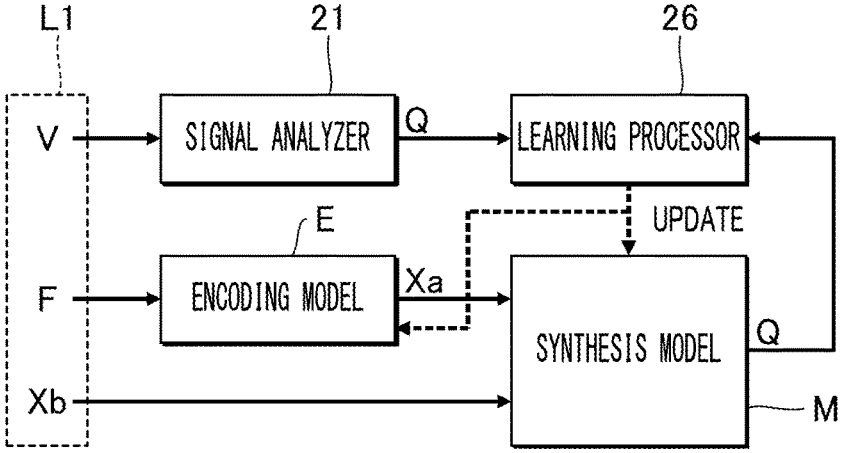
FIG. 4 is an explanatory drawing of pre-training.

FIG. 4 shows a block diagram for the pre-training carried out by the learning processor 26. Pieces of training data L1 stored in the memory 12 are used for the pre-training Each piece of training data L1 includes a piece of ID (identification) information F, condition data Xb, and an audio signal V, each of which belongs to a known singer. Known singers are, basically, individual singers, and differ from an additional singer. Pieces of training data L1 for evaluation are also stored as evaluation data L1 in the memory 12, and are used for determination of the end of the machine learning.

The ID information F refers to a series of numerical values for identifying each of the singers who vocalize singing voices represented by audio signals V.

Specifically, each piece of ID information F has elements corresponding to respective different singers. Among the elements, an element corresponding to a specific singer is set to a numeric value "1", and the remaining elements are set to a numeric value "0", to construct a series of numeric values of one-hot representation as the ID information F of the specific singer. As for the ID information F, one-cold expressions may be adopted, in which "1" and "0" expressed in the one-hot representation are switched to "0" and "1", respectively. For each piece of training data L1, different combinations of the ID information F and the condition data Xb may be provided.

The audio signal V included in any one piece of training data L1 represents a waveform of a singing voice of a tune represented by the condition data Xb, sang by a known singer represented by the ID information F of the training datum L1. In one example, the singing voice which the singer actually vocalizes the tune represented by the condition data Xb is recorded, and the recorded audio signal V is provided in advance. Audio signals V are included in respective pieces of training data L1. The audio signals V represent singing voices of respective known singers, including a singer whose singing voice has similar features to that of the additional singer. In other words, an audio signal V represents a sound of a sound source (a known singer), which is of the same type as an additional sound source for the additional training is used for the pre-training.

The learning processor 26 in the first embodiment collectively trains an encoding model E along with the synthesis model M as the main target of the machine learning. The encoding model E is an encoder that converts a piece of ID information F of a singer into a piece of singer data Xa of the singer. The encoding model E is constituted by, for example, a deep neural network. In the pre-training, the synthesis model M receives supplies of the piece of singer data Xa generated by the encoding model E from the ID information F in the training data L1, and the condition data Xb in the training data L1. As described above, the synthesis model M outputs a series of feature data Q in accordance with the piece of singer data Xa and the condition data Xb. The encoding model E can be composed of a transformation table.

The signal analyzer 21 generates the feature data Q from the audio signal V in each piece of training data L1. Each piece of the feature data Q generated by the signal analyzer 21 represents a series of features (i.e., a series of fundamental frequencies Qa and a series of spectral envelopes Qb), which is of the same type as those of the feature data Q generated by the synthesis model M. The generation of a piece of feature data Q is repeated for each unit period of time (e.g., 5 milliseconds). The series of pieces feature data Q generated by the signal analyzer 21 corresponds to the ground truth for the outputs of the synthesis model M. The series of pieces of feature data Q generated from the audio signals V can be included in the training data L1 instead of the audio signals V. Then, in the pre-training, the analysis of the audio signals V by the signal analyzer 21 can be omitted.

Figure 5:
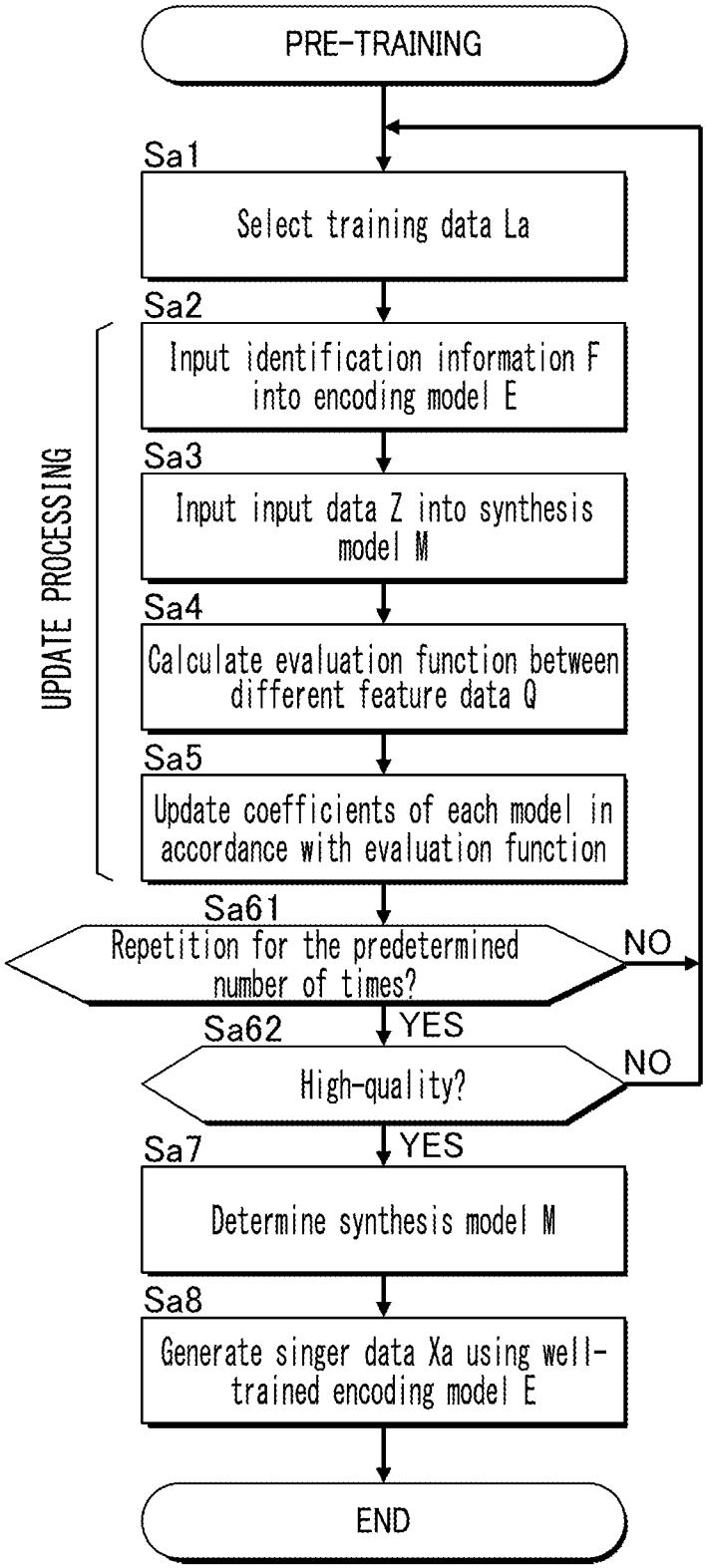
FIG. 5 is a flowchart showing an example of specific steps of the pre-training.

In the pre-training, the learning processor 26 repeats update of the coefficients of each of the synthesis model M and the encoding model E. FIG. 5 is a flowchart showing an example of specific steps of the pre-training carried out by the learning processor 26. Specifically, the pre-training is initiated in response to an instruction input to the input device 14 by the user. The additional training after the execution of the pre-training will be described later.

At the start of the pre-training, the learning processor 26 selects any piece of training data L1 stored in the memory 12 (Sa1). Just after the start of pre-training, a first piece of training data L1 is selected. The learning processor 26 inputs the piece of ID information F in the selected piece of training data L1 in the memory 12 into the tentative encoding model E (Sa2). The encoding model E generates a piece of singer data Xa corresponding to the piece of ID information F. At the time of start of the pre-training, the coefficients of the initial encoding model E are initialized by random numbers, for example.

The learning processor 26 inputs, into the tentative synthesis model M, input data Z including the piece of singer data Xa generated by the encoding model E and the condition data Xb corresponding to the training data L1 (Sa3). The synthesis model M generates a series of pieces of feature data Q in accordance with the input data Z. At the time of the start of the pre-training, the coefficients of the initial synthesis model M are initialized by random numbers, for example.

The learning processor 26 calculates an evaluation function that represents an error between (i) the series of pieces of feature data Q generated by the synthesis model M from the training data L1, and (ii) the series of pieces of feature data Q (i.e., the ground truth) generated by the signal analyzer 21 from the audio signals V in the training data L1 (Sa4). The learning processor 26 updates the coefficients of each of the synthesis model M and the encoding model E such that the evaluation function approaches a predetermined value (typically, zero) (Sa5). In one example, an error backpropagation method is used for updating the coefficients in accordance with the evaluation function.

The learning processor 26 determines whether the update processing described above (Sa2 to Sa5) has been repeated for a predetermined number of times (Sa61). If the number of repetitions of the update processing is less than the predetermined number (Sa61: NO), the learning processor 26 selects the next piece of training data L in the memory 12 (Sa1), and performs the update processing (Sa2 to Sa5) for the piece of training data L. In other words, the update processing is repeated using each piece of training data L.

If the number of times of the update processing (Sa2 to Sa5) reaches the predetermined value (Sa61: YES), the learning processor 26 determines whether the series of pieces of feature data Q generated by the synthesis model M after the update processing has reached the predetermined quality (Sa62). The foregoing evaluation data L stored in the memory 12 are used for evaluation of quality of the feature data Q. Specifically, the learning processor 26 calculates the error between (i) the series of pieces of feature data Q generated by the synthesis model M from the evaluation data L, and (ii) the series of pieces of feature data Q (ground truth) generated by the signal analyzer 21 from the audio signal V in the evaluation data L. The learning processor 26 determines whether the feature data Q have reached the predetermined quality, based on whether the error between the different feature data Q is below a predetermined threshold.

If the series of pieces of feature data Q have not yet reached the predetermined quality (Sa62: NO), the learning processor 26 starts the repetition of the update processing (Sa2 to Sa5) over the predetermined number of times. As is clear from the above description, the qualities of the series of pieces of feature data Q are evaluated for each repetition of the update processing over the predetermined number of times. If the series of pieces of feature data Q have reached the predetermined quality (Sa62: YES), the learning processor 26 determines the synthesis model M at this stage as the final synthesis model M (Sa7). In other words, the coefficients after the latest update are stored in the memory 12 as the pre-trained synthesis model M. The pre-trained synthesis model M established in the above steps is used for the generation of feature data Q carried out by the synthesis processor 24. The learning processor 26 inputs a piece of ID information F of each of the singers into the trained encoding model E determined by the above steps, to generate a piece of singer data Xa (Sa8). After the determination of the pieces of singer data Xa, the encoding model E can be discarded. It is to be noted that the singer space is constructed by the pre-trained encoding model E.

As is clear from the foregoing description, the pre-trained synthesis model M can generate a series of pieces of feature data Q statistically proper for unknown input data Z, under latent tendency between (i) the input data Z corresponding to the training data L1, and (ii) the feature data Q corresponding to the audio signals V of the training data L1. In other words, the synthesis model M learns the relations between the input data Z and the feature data Q. The encoding model E learns the relations between the ID information F and the singer data Xa such that the synthesis model M generates the feature data Q statistically proper for the input data Z. At the end of the pre-training, the training data L1 can be discarded from the memory 12.

Figure 6:
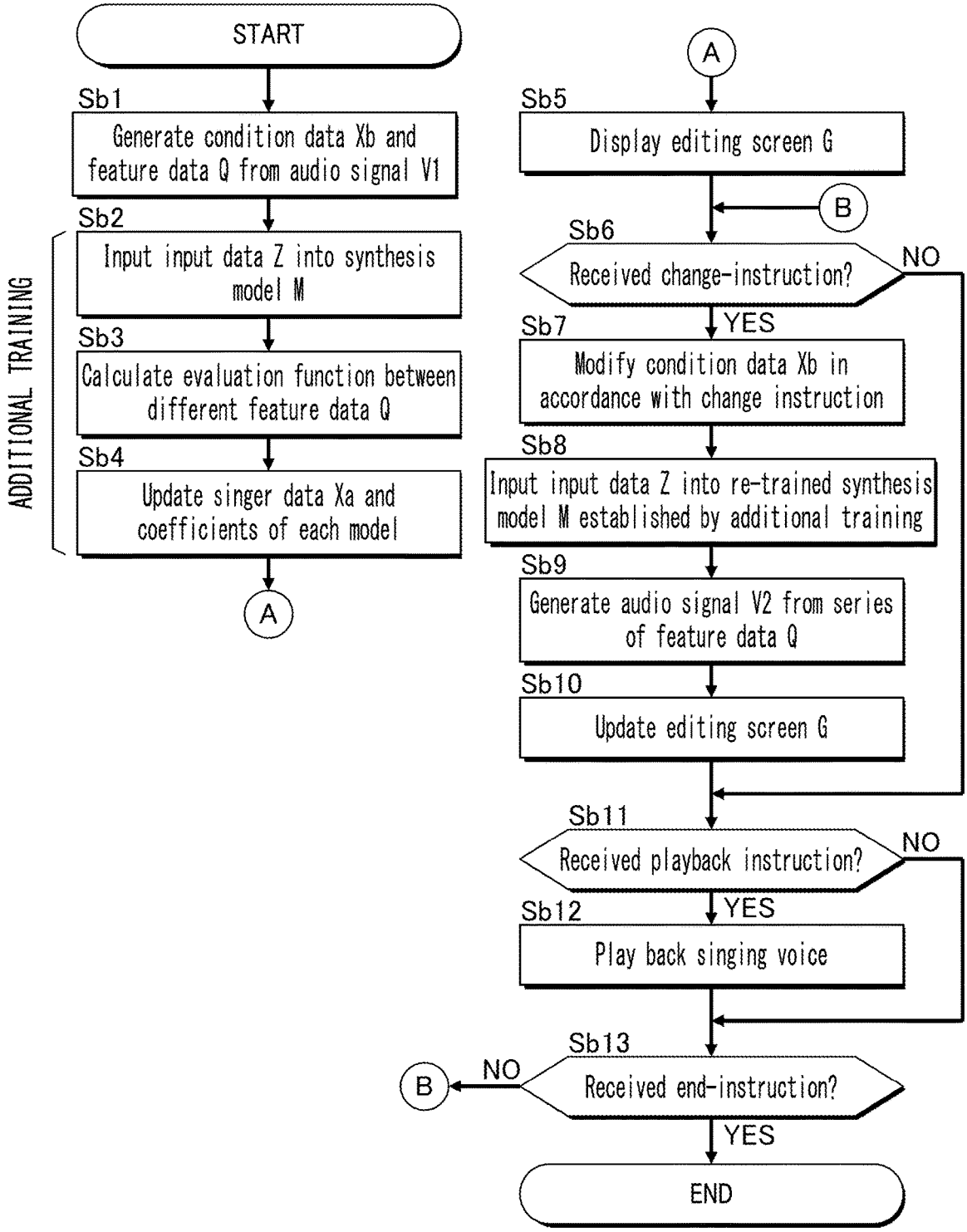
FIG. 6 is a flowchart showing an example of specific steps of operation of the audio processing system.

FIG. 6 is a flowchart showing specific steps of the entire operation of the audio processing system 100 including additional training carried out by the learning processor 26. After the synthesis model M is trained by the foregoing pre-training, the processing shown in FIG. 6 is initiated in response to an instruction input to the input device 14 by the user.

At the start of the processing shown in FIG. 6, the signal analyzer 21 analyzes an audio signal V1, representative of an additional singer and stored in the memory 12, to generate the corresponding condition data Xb and feature data Q (Sb1). The learning processor 26 trains the synthesis model M by additional training with using training data L2 (Sb2 to Sb4). The training data L2 include the condition data Xb and the feature data Q that are generated by the signal analyzer 21 from the audio signal V1. Pieces of training data L2 stored in the memory 12 can be used for the additional training. The condition data Xb in the training data L2 are an example of "first condition data," and the feature data Q in the training data L2 are an example of "first feature data".

Specifically, the learning processor 26 inputs the input data Z into the pre-trained synthesis model M (Sb2). The input data Z include (i) a piece of singer data Xa, which represents the additional singer and is initialized by random numbers or the like, and (ii) the condition data Xb generated from the audio signal V1 of the additional singer. The synthesis model M generates a series of pieces of feature data Q in accordance with the piece of singer data Xa and the condition datum Xb. The learning processor 26 calculates an evaluation function that represents an error between (i) the series of pieces of feature data Q generated by the synthesis model M, and (ii) the series of pieces of feature data Q (i.e., the ground truth) generated by the signal analyzer 21 from the audio signal V1 in the training data L2 (Sb3). The learning processor 26 updates the piece of singer data Xa and the coefficients of the synthesis model M such that the evaluation function approaches the predetermined value (typically, zero) (Sb4). For update of the coefficients in accordance with the evaluation function, the error back-propagation method may be used, in a manner similar to the update of the coefficients in pre-training. The update of the singer data Xa and the coefficients (Sb4) is repeated until feature data Q having sufficient quality are generated by the synthesis model M. The piece of singer data Xa and the coefficients of the synthesis model M are established by the additional training described above.

After the execution of the foregoing additional training, the display controller 22 causes the display 13 to display the editing screen G shown in FIG. 3 (Sb5). The following are disposed in the editing screen G: (i) a series of note images Ga of the notes represented by the condition data Xb generated by the signal analyzer 21 from the audio signal V1, (ii) pitch images Gb indicative of a series of the fundamental frequencies Qa generated by the signal analyzer 21 from the audio signal V1, and (iii) waveform images Gc indicative of the waveform of the audio signal V1.

The user can change the singing condition of the audio signal V1 while viewing the editing screen G. The instruction receiver 23 determines whether an instruction to change a singing condition is input by the user (Sb6). If the instruction receiver receives the instruction to change the singing condition (Sb6: YES), the instruction receiver 23 modifies the initial condition data Xb generated by the signal analyzer 21 in accordance with the instruction from the user (Sb7).

The synthesis processor 24 inputs the input data Z into the re-trained synthesis model M established by the additional training (Sb8). The input data Z include the modified condition data Xb by the instruction receiver 23, and the piece of singer data Xa of the additional singer. The synthesis model M generates a series of pieces of the feature data Q in accordance with the piece of singer datum Xa of the additional singer and the modified condition data Xb. The modified condition data Xb are an example of "second condition data". The feature data Q generated by the synthesis model M by inputting the condition data Xb are an example of "second feature data.

The signal generator 25 generates the audio signal V2 from the series of pieces of feature data Q generated by the synthesis model M (Sb9). The display controller 22 updates the editing screen G to reflect the following: (i) the change instruction from the user, and (ii) the audio signal V2 generated by the re-trained synthesis model M established by the additional training (Sb10). Specifically, the display controller 22 updates the series of note images Ga according to the singing condition modified by the user's instructions. Furthermore, the display controller 22 updates the pitch images Gb on the display 13 to indicate the series of fundamental frequencies Qa of the audio signal V2 generated by the signal generator 25. In addition, the display controller 22 updates the waveform images Gc to indicate the waveforms of the audio signal V2.

The controller 11 determines whether the playback of the singing voice is instructed by the user (Sb11). If the playback of the singing voice is instructed (Sb11: YES), the controller 11 supplies the audio signal V2 generated by the above steps to the sound output device 15, to play back the singing voice (Sb12). In other words, the singing voice corresponding to the singing conditions modified by the user is emitted from the sound output device 15. If any modification of the singing conditions is not instructed (Sb6: NO), the following are not executed: a modification of condition data Xb (Sb7), a generation of an audio signal V2 (Sb8, Sb9), and an update of the editing screen G (Sb10). In this case, if the playback of the singing voice is instructed by the user (Sb11: YES), the audio signal V1 stored in the memory 12 is supplied to the sound output device 15, and the corresponding singing voice is played back (Sb12). If the playback of the singing voice is not instructed (Sb11: NO), the audio signal V (V1, or V2) is not supplied to the sound output device 15.

The controller 11 determines whether an instruction to end the processing has been input by the user (Sb13). If the controller 11 doesn't receive the instruction to end the processing (Sb13: NO), the controller 11 moves the processing to step Sb6, and receives an instruction from the user to modify a singing condition.

As is clear from the foregoing description, for each instruction to modify the corresponding singing condition, the following are executed: (i) modification of the condition data Xb (Sb7), (ii) generation of the corresponding audio signal V2 by the re-trained synthesis model M established by the additional training (Sb8, Sb9), and (iii) update of the editing screen G (Sb10).

In the foregoing description, in the first embodiment, additional training is carried out on the pre-trained synthesis model M, in which condition data Xb and feature data Q identified from the audio signal V1 of the additional singer are used for the additional training. The condition data Xb representative of the modified singing conditions are input into the re-trained synthesis model M established by the additional training, thereby generating the feature data Q of the singing voice vocalized by the additional singer according to the changed singing conditions. Accordingly, it is possible to suppress a decline of sound quality due to a modification of the singing conditions, as compared to the conventional configuration in which an audio signal is directly modified according to the user's instruction of change.

In the first embodiment, the pre-trained synthesis model M can be established using an audio signal V representative of a singing voice of a sound source. This sound source is of the same type as a singer (i.e., an additional singer) of a singing voice represented by an audio signal V2. Accordingly, even if small amount of audio signals V1 of the additional singer are available, it is possible for the synthesis model M to generate with high accuracy the feature data Q of the singing voice vocalized according to the modified singing conditions.

Second Embodiment

The second embodiment will be described. In each of the following examples, for elements having functions that are the same as those of the first embodiment, the same reference signs as used in the description of the first embodiment will be used, and detailed description thereof will be omitted as appropriate.

In the first embodiment, a piece of singer data Xa of an additional singer is generated with using an encoding model E trained by pre-training. In case where the encoding model E is discarded after the generation of pieces of singer data Xa, the singer space cannot be reconstructed at the additional training stage. In the second embodiment, the encoding model E is not discarded in step Sa8 in FIG. 5, so that the singer space can be reconstruct. In this case, the additional training can be carried out so as to extend the acceptable range of condition data Xb by the synthesis model M. In the following, the additional training of the synthesis model M regarding to an additional singer is described. Prior to the processing shown in FIG. 5, unique ID information F is assigned to an additional singer to distinguish the singer from other singers. After that, a piece of condition data Xb and a piece of feature data Q are generated from an audio signal V1 representative of a singing voice of the additional singer by the processing of step Sb1 shown in FIG. 6. Then, the generated pieces of condition data Xb and feature data Q are additionally stored to the memory 12, as one piece of the pieces of training data L1.

In the steps Sa1 to Sa6 shown in FIG. 5, the following steps are the same as those in the first embodiment: (i) the step of executing the additional training with using the pieces of training data L1 including the piece of condition data Xb and the piece of feature datum Q and, (ii) the steps of updating coefficients of each of the synthesis model M and the encoding model E. In other words, in the additional training, the synthesis model M is retrained such that the features of the singing voice of the additional singer is reflected to the synthesis model M while the singer space of the singers is reconstructed. The learning processor 26 retrains the pre-trained synthesis model M using the piece of training data L1 of the additional singer, such that the synthesis model M can synthesize the singing voice of the additional singer.

In the second embodiment, by adding an audio signal V1 of a singer to the training data L1, qualities of singing voices of singers, synthesized using the synthesis model M, can be improved. It is possible for the synthesis model M to generate with high accuracy the singing voice of the additional singer from the synthesis model M, even if small amount of audio signals V1 of the additional singer is available.

Modifications

Examples of specific modifications to be made to the foregoing embodiments will be described below. Two or more modifications freely selected from among the examples below may be appropriately combined as long as they do not conflict with each other.

Figure 7:
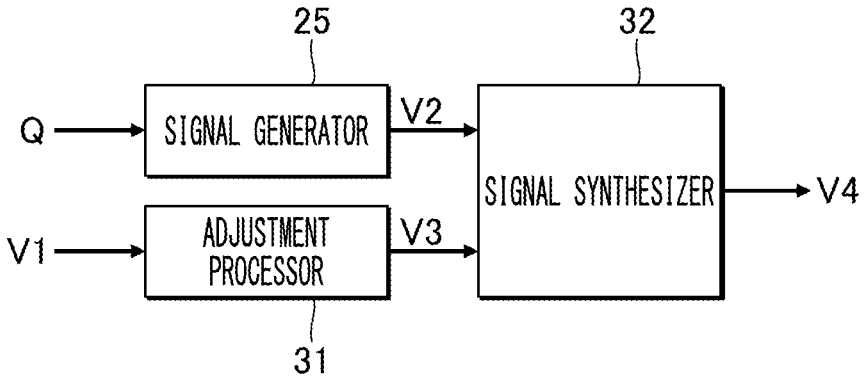
FIG. 7 is a block diagram showing an example of a functional configuration of the audio processing system in a modification.

(1) In each foregoing embodiment, the audio signal V2 is generated with using the synthesis model M. However, the generation of the audio signal V2 by use of the synthesis model M can be used together with the direct modification of the audio signal V1. Specifically, as shown in FIG. 7, the controller 11 acts as the adjustment processor 31 and the signal synthesizer 32, in addition to the same elements as those in each of the foregoing embodiments. The adjustment processor 31 modifies an audio signal V1 stored in the memory 12 according to the user's instruction to modify the singing condition, to generate an audio signal V3. Specifically, if the user's instruction is for modifying a pitch of a specific note, the adjustment processor 31 generates the audio signal V3 by modifying the pitch of a time section of the audio signal V1 corresponding to the note in accordance with the instruction. Furthermore, if the user's instruction is for modifying a pronunciation period of a particular note, the adjustment processor 31 generates the audio signal V3 by stretching or shrinking, on the time axis, a time section of the audio signal V1 corresponding to the note. Any known technique may be used for modifying the pitch, or stretching/shrinking the time section of the audio signal V1. The signal synthesizer 32 synthesizes the following to generate an audio signal V4: (i) an audio signal V2 generated by the signal generator 25 from the feature data Q generated by the synthesis model M, and (ii) the audio signal V3 generated by the adjustment processor 31 shown in FIG. 7. The audio signal V4 generated by the signal synthesizer 32 is supplied to the sound output device 15.

The signal synthesizer 32 evaluates sound quality of either of the following: the audio signal V2 generated by the signal generator 25, and the audio signal V3 generated by the adjustment processor 31. Then, the signal synthesizer 32 adjusts the mixing ratio of the audio signal V2 and the audio signal V3, in accordance with the result of the evaluation. The sound quality of the audio signal V2 or the audio signal V3 can be evaluated by any index value such as Signal-to-Noise (SN) ratio or Signal-to-Distortion (SD) ratio. Specifically, the signal synthesizer 32 sets the mixing ratio of the audio signal V2 to the audio signal V3 to a higher value, as the sound quality of the audio signal V2 is higher. Accordingly, if the sound quality of the audio signal V2 is higher, the generated audio signal V4 predominantly reflects the audio signal V2. If the sound quality of the audio signal V2 is lower, the generated audio signal V4 predominantly reflects the audio signal V3. Any one of the audio signals V2 and V3 can be selected according to the sound quality of the audio signal V2 or V3. Specifically, if the index of the sound quality of the audio signal V2 exceeds a threshold, the audio signal V2 is selectively supplied to the sound output device 15. If the index is below the threshold, the audio signal V3 is selectively supplied to the sound output device 15.

(2) In each foregoing embodiment, the audio signal V2 is generated for the entire tune. However, the audio signal V2 may be generated for a time section of a tune, in which the section is identified by the user's instruction to change the singing condition. The generated audio signal V2 is combined with the audio signal V1. The audio signal V2 can be crossfaded with respect to the audio signal V1 such that the start point or the end point of the audio signal V2 is not clearly perceptible by the sound.

(3) In each foregoing embodiment, the learning processor 26 executes both the pre-training and the additional training. However, the pre-training and the additional training may be carried out by separate entities. Specifically, in a configuration in which the synthesis model M has already been established by pre-training carried out by an external device, and the learning processor 26 executes the additional training on the synthesis model M. In this case, the learning processor 26 is not required to carry out the pre-training. Specifically, a machine learning device (e.g., a server device) communicable with a terminal device generates a synthesis model M by executing the pre-training, and distributes the synthesis model M to the terminal device. The terminal device includes a learning processor 26 that carries out the additional training of the synthesis model M distributed by the machine learning device.

(4) In each foregoing embodiment, singing voices vocalized by singers are synthesized. However, the present disclosure also applies to the synthesis of various sounds other than singing voices. In one example, the disclosure also applies to synthesis of general voices, such as spoken voices that do not require music, as well as synthesis of musical sounds produced by musical instruments. The piece of singer data Xa correspond to an example of pieces of sound source data representative of various sound sources, the sound sources including speaking persons or musical instruments and the like, in addition to singers. In addition, condition data Xb comprehensively represents sounding conditions including pronouncing conditions (e.g., phonetic identifiers) or performance conditions (e.g., pitches and volumes) in addition to singing conditions. The synthesis data Xc for the performances of instruments don't include phonetic identifiers.

(5) In each of the foregoing embodiments, an example is described of a configuration in which the feature data Q includes the fundamental frequency Qa and the spectral envelope Qb. However, the feature data Q are not limited to the foregoing examples. A variety of data representative of features of a frequency spectrum (hereinafter, referred to as "spectral feature") are used as the feature data Q. Examples of the spectral feature available as the feature data Q include Mel Spectrum, Mel Cepstral, Mel Spectrogram and a spectrogram, in addition to the foregoing spectral envelopes Qb. In a configuration in which spectral features which could specify fundamental frequencies Qa are used as feature data Q, the fundamental frequencies Qa may be excluded from the feature data Q.

(6) The functions of the audio processing system 100 in each foregoing embodiment are realized by collaboration between a computer (e.g., a controller 11) and a program. The program according to one aspect of the present disclosure is provided in a form stored on a computer-readable recording medium and is installed in a computer. The recording medium is a non-transitory recording medium, a typical example of which is an optical recording medium (an optical disk), such as a CD-ROM. However, examples of the recording medium include any known form of recording medium, such as a semiconductor recording medium or a magnetic recording medium. Examples of the non-transitory recording media include any recording medium other than transitory and propagating signals, and does not exclude volatile recording media. The program may be provided to a computer in the form of distribution over a communication network.

(7) The entity that executes artificial intelligence software to realize the synthesis model M is not limited to a CPU. Specifically, the artificial intelligence software may be executed by a processing circuit dedicated to neural networks, such as a Tensor Processing Unit or a Neural Engine, or by any Digital Signal Processor (DSP) dedicated to an artificial intelligence. The artificial intelligence software may be executed by collaboration among processing circuits freely selected from the above examples.

The following configurations are derivable in view of the foregoing embodiments.

An audio processing method according to an aspect of the present disclosure (Aspect 1) is implemented by a computer, and includes establishing a re-trained synthesis model by additionally training a pre-trained synthesis model for generating feature data representative of acoustic features of an audio signal according to condition data representative of sounding conditions, using: first condition data representative of sounding conditions identified from a first audio signal of a first sound source; and first feature data representative of acoustic features of the first audio signal; receiving an instruction to modify at least one of the sounding conditions of the first audio signal; generating second feature data by inputting second condition data representative of the modified at least one sounding condition into the re-trained synthesis model established by the additional training; and generating a modified audio signal in accordance with the generated second feature data.

In this aspect, in a synthesis model, additional training is executed by use of (i) first condition data representative of sounding conditions identified from an audio signal, and (ii) first feature data of the audio signal. Second feature data representative of a sound according to modified sounding conditions are generated by inputting second condition data representative of the modified sounding conditions into the re-trained synthesis model established by the additional training. It is possible to suppress a decrease in sound quality due to modifications of an audio signal in accordance with modifications of sounding conditions, as compared to a conventional configuration in which an audio signal is directly modified in accordance with a change instruction.

In one example (Aspect 2) of Aspect 1, the pre-trained synthesis model is established by machine learning using a second audio signal of a second sound source of the same type as the first sound source of the first audio signal.

In this aspect, a pre-trained synthesis model is established using an audio signal of a sound source of the same type as an additional sound source of the audio represented by the audio signal. It is possible for the synthesis model M to generate with high accuracy second feature data of a sound according to the modified sounding condition.

In one example (Aspect 3) of Aspect 1 or 2, the audio processing method further includes generating the second feature data by inputting: the second condition data representative of the modified sounding condition; and sound source data into the re-trained synthesis model, wherein the sound source data represents a position corresponding to the first sound source among different sound sources within a space representative of relations between acoustic features of the different sound sources.

In one example (Aspect 4) of any one of Aspects 1 to 3, the sounding conditions of the first audio signal include a pitch of each note in the first audio signal, and the instruction to modify instructs to modify the pitch of at least one note in the sounding conditions of the first audio signal.

According to this aspect, it is possible to generate the second feature data of a high quality sound according to the modified pitch.

In one example (Aspect 5) of any one of Aspects 1 to 4, the sounding conditions of the first audio signal include a sound period of each note in the first audio signal, and the instruction to modify instructs to modify the sound period of at least one note in the sounding conditions of the first audio signal.

In one example (Aspect 6) of any one of Aspects 1 to 5, the sounding conditions of the first audio signal include a phonetic identifier of each note in the first audio signal, and the instruction to modify instructs to modify the phonetic identifier of at least one note in the sounding conditions of the first audio signal. According to this aspect, it is possible to generate the second feature data of a high quality sound according to the modified phonetic identifier.

Each aspect of the present disclosure is achieved as an audio processing system that implements the audio processing method according to each foregoing embodiment, or as a program that is implemented by a computer for executing the audio processing method.

DESCRIPTION OF REFERENCE SIGNS

100 . . . Audio processing system, 11 . . . controller, 12 . . . memory, 13 . . . display, 14 . . . Input device, 15 . . . sound output device, 21 . . . signal analyzer, 22 . . . display controller, 23 . . . instruction receiver, 24 . . . synthesis processor, 25 . . . signal generator, 26 . . . learning processor, M . . . synthesis model, Xa . . . singer data, Xb . . . condition data, Z . . . input data, Q . . . feature data, V1 and V2 . . . audio signal, F . . . identification (ID) information, E . . . encoding model, L1 and L2 . . . training data.

What is claimed is:

1. An audio processing method implemented by a computer, the audio processing method comprising:

generating a pre-trained synthesis model from a training audio signal including:

condition data representing sounding conditions including a phonetic identifier of each note; and feature data representing audio spectral features;

establishing a re-trained synthesis model by additionally training the pre-trained synthesis model using a first audio signal including:

first condition data representing first sounding conditions including a phonetic identifier of each note; and first feature data representing first audio spectral features;

receiving an instruction to modify a sounding period of at least one note in the first sounding conditions of the first audio signal to generate second condition data representing the modified first sounding condition;

generating second feature data representing modified first audio spectral features by inputting the generated second condition data into the re-trained synthesis model; and generating a modified first audio signal by inputting the generated second feature data to a signal generator.

2. The audio processing method according to claim 1, wherein the training audio signal is a second sound source of a same type as a first sound source of the first audio signal.

3. The audio processing method according to claim 1, wherein:

the generating of the second feature data further inputs sound source data into the re-trained synthesis model, and the sound source data represents a position corresponding to the first sound source among different sound sources within a space representative of relations between acoustic features of the different sound sources.

4. The audio processing method according to claim 1, wherein:

the first sounding conditions include a pitch of each note in the first audio signal, and the instruction to modify instructs to modify the pitch of at least one note in the first sounding conditions.

5. The audio processing method according to claim 1, further comprising receiving instruction to modify phonetic identifier of at least one note in the first sounding conditions.

6. A non-transitory medium storing a program executable by a computer to an audio processing system to execute a method comprising:

generating a pre-trained synthesis model from a training audio signal including:

condition data representing sounding conditions including a phonetic identifier of each note; and feature data representing audio spectral features;

establishing a re-trained synthesis model by additionally training the pre-trained synthesis model using a first audio signal including:

first condition data representing first sounding conditions including a phonetic identifier and a sounding period of each note; and first feature data representing first audio spectral features;

receiving an instruction to modify the sounding period of at least one note in the first sounding conditions of the first audio signal to generate second condition data representing the modified first sounding condition;

generating second feature data representing modified first audio spectral features by inputting the generated second condition data into the re-trained synthesis model; and generating a modified first audio signal by inputting the generated second feature data to a signal generator.

7. An audio processing system comprising:

at least one memory storing instructions; and at least one processor that implements the instructions to:

generate a pre-trained synthesis model from a training audio signal including:

condition data representing sounding conditions including a phonetic identifier of each note; and feature data representing audio spectral features;

establish a re-trained synthesis model by additional training the pre-trained synthesis model using a first audio signal including:

first condition data representing first sounding conditions, including a phonetic identifier and a sounding period of each note; and first feature data representing first audio spectral features;

receive an instruction to modify the sounding period of at least one note in the first sounding conditions of the first audio signal to generate second condition data representing the modified first sounding condition;

generate second feature data representing modified first audio spectral features by inputting the generated second condition data into the re-trained synthesis model; and generate a modified first audio signal by inputting the generated second feature data to a signal generator.

* * * * *